United States Patent [19]

Sasaki et al.

[11] Patent Number: 4,842,352

[45] Date of Patent: Jun. 27, 1989

[54] CHIP-LIKE INDUCTANCE ELEMENT

[75] Inventors: Yoshinori Sasaki, Honjo; Toshihiro Kuroshima, Yamagata, both of Japan

[73] Assignee: TDK Corporation, Tokyo, Japan

[21] Appl. No.: 254,325

[22] Filed: Oct. 5, 1988

[51] Int. Cl.[4] ..... H01F 15/02; H01F 15/10

[52] U.S. Cl. ..... 336/83; 336/192; 336/212

[58] Field of Search ..... 336/192, 83, 212, 233

[56] References Cited

U.S. PATENT DOCUMENTS 3,750,069 7/1973 Renskers ..... 336/192 X 4,314,221 2/1982 Satou et al. ..... 336/83

*Primary Examiner*—Thomas J. Kozma

*Attorney, Agent, or Firm*—Panitch, Schwarze, Jacobs and Nadel

[57] ABSTRACT

A chip-like inductance element including a magnetic sleeve having a feed-through hole between end surfaces thereof and electrode layers fromed on the end surfaces, and a drum-like magnetic bobbin fitted in the hole such that a gap is formed between the bobbin and sleeve and including end flanges and a central cylindrical region for a coil winding therearound, comprises solder layers for connecting terminals of the coil winding to the electrode layers, and insulating layers covering the solder layers and the end surfaces of the drum-like magnetic bobbin and being filled in the gap.

4 Claims, 4 Drawing Sheets

CHIP-LIKE INDUCTANCE ELEMENT

BACKGROUND OF THE INVENTION

1. Field of the Invention

This invention relates to a chip-like inductance element, and more particularly relates to a chip-like inductance element which has a cylindrical shape or a shape of a rectangular parallelepiped.

2. Description of the Prior Art

The prior art will be explained by reference to FIGS. 6 through 8 and FIG. 2 according to the present invention.

FIG. 6 is an enlarged perspective view of a magnetic sleeve 31 according to the prior art which the present applicant has proposed in Japanese Utility Model Application No. 60-156,489 (1985).

As is apparent from FIG. 6, a hole 37 is formed in a nearly central portion in both end surfaces 35, 35 of the magnetic sleeve 31. Electrode layers 33, 33' are continuously printed or coated on the circumference of the hole in the both end surfaces 35, 35 and on the entire surfaces of both side surfaces 36, 36 of the magnetic sleeve. Such a magnetic sleeve 31 wherein the electrode layers 33, 33' are coated on the entire surfaces of the both side surfaces 36, 36 other than the end surfaces 35, 35 in which the hole 37 is formed, and the shape of the both side surfaces 36, 36 is square will be called a square magnetic sleeve. On the other hand, a magnetic sleeve in FIG. 5 according to an embodiment of the present invention will be called a rectangular parallelepiped-type magnetic sleeve 1' for the purpose of discrimination. FIG. 2 is an enlarged perspective view of a drum-like magnetic bobbin 9 according to the present invention, which will be used for the convenience of explaining the prior art. As is apparent from FIG. 2, a coil winding 21 is wound on the drum-like magnetic bobbin 9. Guide grooves 19, 19 for drawing out coil winding terminals are formed in side portions of end flanges 11, 11 of the drum-like magnetic bobbin. Also, conductive films 17, 17 are printed or coated on both end surfaces 13, 13 of the end flanges 11, 11. Coil winding terminals 15, 15 are drawn out through the guide grooves 19, 19, and are folded and fixed on the conductive films 17, 17. Such a drum-like magnetic bobbin 9 is fitted in the hole 37 in the square magnetic sleeve 31 in FIG. 6. A production method for obtaining a desired chiplike inductance element will be briefly described by reference to FIGS. 7 and 8. FIG. 7 is an enlarged crosssectional view taken along line VII—VII in FIG. 6 showing a state in which the drum-like magnetic bobbin 9 is inserted in the hole 37 of the square magnetic sleeve 31. Hereafter, for the convenience of explanation, the explanation will be made about the upper coil winding terminal 15. The situation is the same for the lower coil winding terminal 15. A large circular conductive metal plate 43 which is larger than the hole 37, and on which a solder layer 39 has previously been formed is prepared. A suitable flux is coated on a portion where solder connection is to be performed before performing solder connection. Then, the solder layer 39 is faced down and the conductive metal plate 43 is heated from above to fuse the solder layer 39, and thus unified simultaneous solder connection of the drawn-out coil winding terminal 15, the conductive film 17, the electrode layer 33 around the hole and the conductive metal plate 43 is performed. After finishing the desired solder connection, an insulating layer 45 is coated (see FIG. 8). As described above, a chip-like inductance element 27 can be obtained.

Q value is generally used for representing the characteristic of an inductance element. The Q value determines the frequency selection characteristic of a tuning circuit, such as an L-C parallel circuit. It is known that when the Q value is higher, the frequency selection characteristic becomes better. It has become clear, however, that in some cases, the Q value of the chip-like inductance element 27 obtained as described above decreases. The present inventors have found, after several analyses and investigations on the causes of the decrease of the Q value, that the decrease of the Q value is due to the following causes (see FIGS. 7 and 8).

(a) Chemical effect on the coil winding such that the flux flows into the hole 37 from a gap 38 formed between the square magnetic sleeve 31 and the drum-like magnetic bobbin 9 during solder connection to adhere to the coil winding 21.

(b) The electrode layers 33, 33' are printed or coated around the hole 37 in the end surfaces 35, 35 of the square magnetic sleeve, so the electrode layers 33, 33' occasionally adhere to the inner wall of the hole 37, and this results in increase in eddy-current loss.

(c) The bonding between the magnetic sleeve and the drum-like magnetic bobbin only by the solder layers 39, 39 and the electrode layers 33, 33' is in some cases mechanically insufficient.

It has also become clear that the above-described (a), (b) and (c) deteriorate in some cases other characteristics of the chip-like inductance element than the Q value.

On the other hand, the completed chip-like inductance element 27 is finally to be mounted to a predetermined location on a printed circuit board by solder connection, and it is preferable to simultaneously mount a plurality of chip elements on a printed circuit board from a viewpoint of achieving lower mounting cost. Such a mounting method will be called a multi-mounting method. In the multi-mounting method, a plurality of chip elements pass through a tube and are dropped into a template having predetermined position-determining holes for elements by a suitable element-supplying hopper. An ultraviolet curing-type resin, for example, has previously been coated on the printed circuit board. The printed circuit board is pressed from below, then is turned upside down and the template is removed, and is subsequently irradiated by an ultraviolet lamp to fix the chip elements. After mounting other electronic components, such as components having leads, on the printed circuit board, all chip elements or electronic components are simultaneously solder connected. The multi-mounting method has an excellent productivity, so it has a feature that the mounting cost is lower as described above. The multi-mounting method cannot be used, however, for conventional square chip-like inductance elements in which the shape of the both side surfaces 36, 36 printed or coated with the electrode layers 33, 33' is square, due to reasons, such as diffuculty in position dermination by the template, so there is a problem that the mounting cost of square chip-like inductance elements becomes high. It is impossible to modify these elements into a cylinder type, because the external electrode layers 33, 33' are located on both end surfaces, and the drum-like bobbin is in a feed-through hole which is parallel to them.

On the other hand, there exists an idea that a hole fed through from the electrode layer 33 to the electrode layer 33' is used for fitting the drum-like magnetic bobbin, and thus it becomes possible to use a cylinder sleeve. However, the above-described problems, such as the penetration of the flux, the eddy-current loss due to adherence of the electrode layers 33, 33' to the inner wall of the hole 37, cannot be solved.

SUMMARY OF THE INVENTION

It is an object of the present invention to provide a chip-like inductance element which has excellent characteristics with constant quality without decrease in Q value.

It is another object of the present invention to provide a chip-like inductance element which has a lower mounting cost.

The outline of the present invention will be explained by reference to FIGS. 1 through 5.

According to the present invention, electrode layers 3, 3 are printed or coated on entire end surfaces 5, 5 of a magnetic sleeve 1 in which a feed-through hole 7 is formed. The shape of the end surfaces 5, 5 are preferably circular, but it may be square as shown in FIG. 5. The present invention provides a feature in that conductive films 17, 17 of a drumlike magnetic bobbin 9 are formed in the central area of end surfaces 13, 13 of the bobbin 9 on which coil winding terminals 15, 15 are attached, electrode layers 3, 3 are formed on the end surfaces 5, 5 of the sleeve 1, and metal plates 23 with solder layers 29 are used to connect together electrode layers 3, 3, the conductive films 17, 17 and the coil terminals 15, 15, leaving a part of the circumference of the end surfaces 13, 13 in an exposed condition. Further, insulating layers 25, 25 are not only formed on the solder layers 29, 29 but also is filled in a gap 28 between the magnetic sleeve 1, 1' and the drum-like magnetic bobbin 9.

BRIEF DESCRIPTION OF THE DRAWINGS

The name which each numeral indicates in the figures will be listed hereafer. It will be noted that like numerals indicate like portions.

1, 1': (cylindrical-type, rectangular parallelepiped-type) magnetic sleeve.
3, 3: electrode layers.
5, 5: end surfaces of cylindrical magnetic sleeve.
7: hole.
9: drum-like magnetic bobbin.
11, 11: end flanges of drum-like magnetic bobbin.
13, 13: end surfaces of drum-like magnetic bobbin.
15, 15: coil winding terminals.
17, 17: conductive films.
19, 19: guide grooves.
21: coil winding.
23, 23: conductive metal plates.
25, 25: insulating layers.
27: inductance element.
28: gap.
29, 29: solder layers.
31: square magnetic sleeve.
33, 33': electrode layers.
35, 35: end surfaces of square magnetic sleeve.
36, 36: side surfaces of square magnetic sleeve.
37: hole.
38: gap.
39, 39: solder layers.
43, 43: conductive metal plates.
45, 45: insulating layers.

DETAILED DESCRIPTION OF THE PREFERRED EMBODIMENTS

Now, the preferred embodiments of the present invention will be explained with reference to FIGS. 1 through 5.

Figure 1:
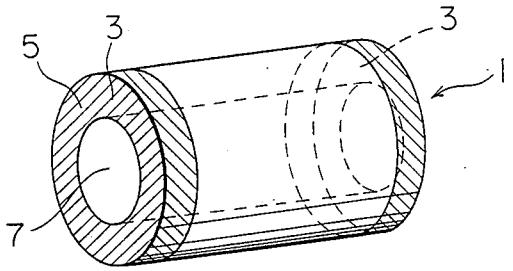
FIG. 1 is an enlarged perspective view of a magnetic sleeve of a cylindrical chip-like inductance element according to the present invention.
Figure 2:
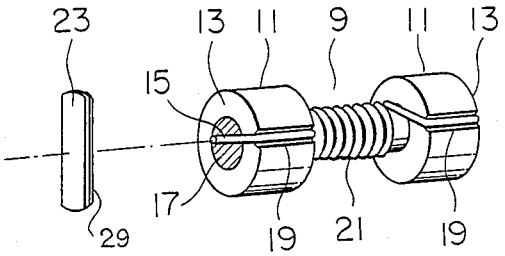
FIG. 2 is an enlarged perspective view of a drum-like magnetic bobbin of a cylindrical chip-like inductance element according to the present invention.
Figure 3:
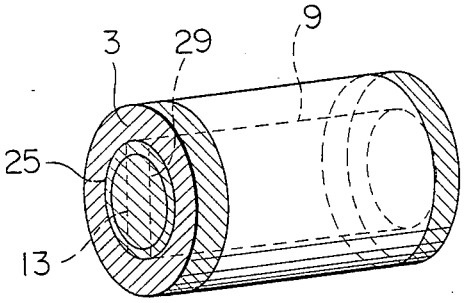
FIG. 3 is an enlarged perspective view of a cylindrical chip-like inductance element according to the present invention in which solder layers and insulating layers are formed.
Figure 4:
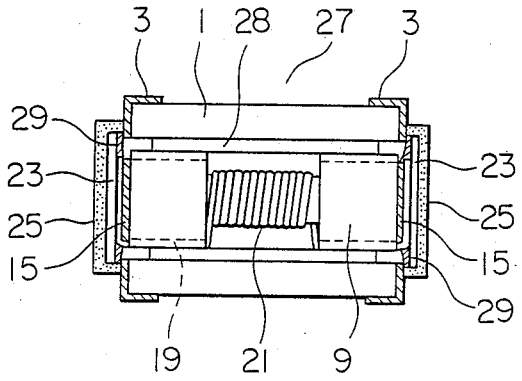
FIG. 4 is an enlarged cross-sectional view taken along the long axis line of the cylindrical chip-like inductance element in FIG. 3.

FIG. 1 is a perspective view of a cylindrical magnetic sleeve 1 according to the present invention. The cylindrical magnetic sleeve 1 is obtained by pressure-forming presintered magnetic powder (preferably ferrite) and by subsequent sintering. Electrode layers 3, 3 are printed or coated in entire end surfaces 5, 5 of the cylindrical magnetic sleeve 1. The electrode layers 3, 3 are preferably formed by silver-palladium alloy (Ag - Pd) or the like. FIG. 2 is a perspective view of a drum-like magnetic bobbin 9 according to the present invention. The drum-like magnetic bobbin 9 is obtained by pressure-forming presintered magnetic powder (preferably ferrite) and by subsequent sintering. A coil winding 21 is wound in a cylindrical region which is located in the center of the drum-like magnetic bobbin 9. Conductive films 17, 17 are formed on end surfaces 13, 13 of two end flanges 11, 11 of the drum-like magnetic bobbin. The conductive films 17, 17 are preferably formed by silver-palladium alloy (Ag - Pd) or the like. Guide grooves 19, 19 for drawing out coil winding terminals are formed in side portions of end flanges 11, 11 of the drumlike magnetic bobbin. Coil winding terminals 15, 15 are drawn out through the guide grooves 19, 19 to the end surfaces 13, 13 and are folded and fixed on the conductive film 17. The diameter of the coil winding 21 is, in general, preferably about 0.03 mm–0.05 mm. The drum-like magnetic bobbin 9 having such a configuration is inserted in a feedthrough hole 7 of the cylindrical magnetic sleeve 1. The production method of chip-like inductance elements according to the present invention will be hereinafter explained. For the convenience of explanation, however, the explanation will be made about the left coil winding terminal 15. A conductive metal plate 23 on which a solder layer 29 has previously been formed is prepared. The length of the conductive metal plate 23 must be longer than the diameter of the feed-through hole 7 of the cylindrical magnetic sleeve 1, and the width thereof must be smaller than the diameter of the end surface 13 of the drum-like magnetic bobbin 9. The thickness of the solder layer on the conductive metal plate is generally about 15 μm. A suitable flux is coated on a region where solder connection is to be performed. Then, the conductive metal plate 23 is heated with the solder layer 29 facing toward the coil winding terminal to fuse the solder layer 29, and the drawn-out coil winding terminal 15, the conductive film 17, the electrode layer 3 and the conductive metal plate 23 are simuntaneously solder connected. The solder connection is performed so that the end surface 13 and the electrode layer 3 are connected together except a part of the circumference of the end surface 13. There is a minute gap 28 (see FIG. 4) between the cylindrical magnetic sleeve 1 and the drum-like magnetic bobbin 9. Accordingly, it is possible to remove the flux or the like adhered to the coil winding 21 via the gap 28, by utilizing a part of the circumference of the end surface 13 on which solder connection has not been performed. After finishing cleaning of the coil winding 21, an insulating layer 25 is formed so that it covers the metal plate 23, conductive film 17 and the exposed portion of the end surface 13, as shown in FIGS. 3 and 4. The insulating layer 25 is also filled in the gap 28 through a part of the circumference of the end surface on which solder connection has not been performed. The situation is the same for the right coil winding terminal 15.

As described above, a cylindrical chip-like inductance element according to the present invention as shown in FIG. 4 can be obtained.

Figure 5:
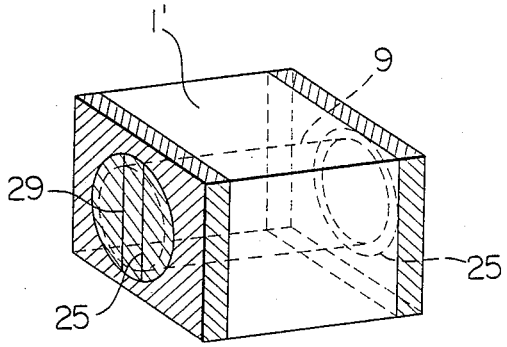
FIG. 5 is an enlarged perspective view of a chip-like inductance element having a shape of a rectangular parallelepiped according to the present invention.
Figure 6:
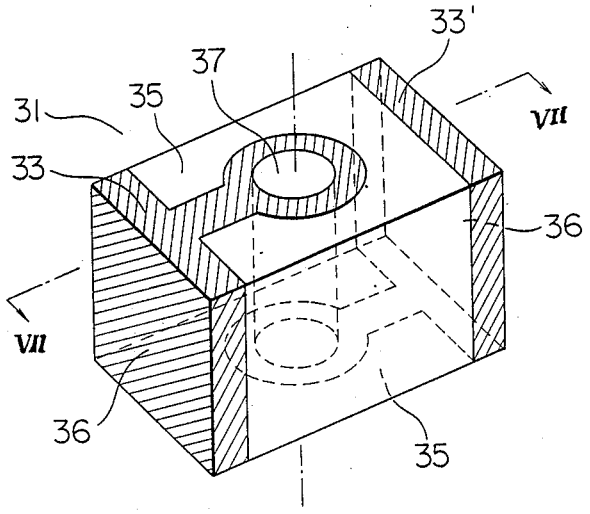
FIG. 6 Prior Art
FIG. 6 is an enlarged perspective view of a magnetic sleeve of a square chip-like inductance element according to the prior art.
Figure 7:
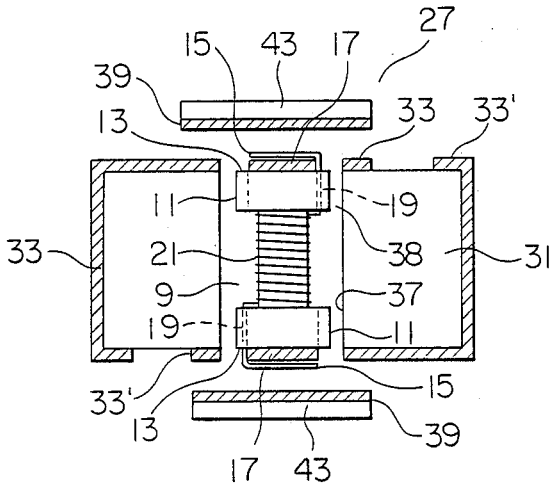
FIG. 7 Prior Art
FIG. 7 is an enlarged cross-sectional view showing a method of solder connection for a chip-like inductance element according to the prior art.
Figure 8:
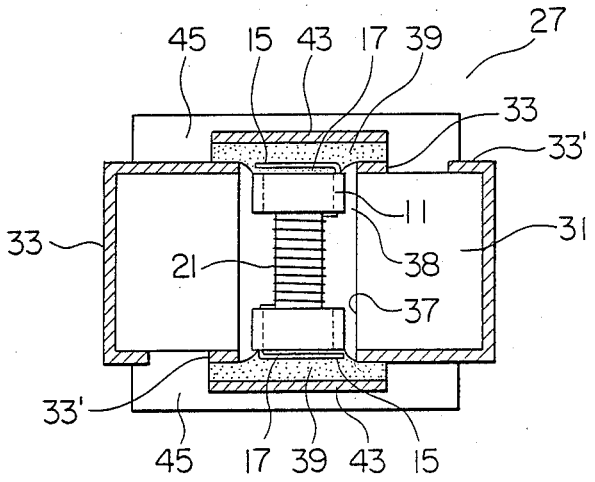
FIG. 8 Prior Art
FIG. 8 is an enlarged cross-sectional view of a square chip-like inductance element according to the prior art in which insulating layers are formed.

It is also possible to provide a chip-like inductance element having a shape of a rectangular parallelepiped in which the shape of end surfaces where a hole is to be formed is square, as shown in FIG. 5.

Action of Effect of the Invention

According to the present invention, the solder layer 29 for connecting together the conductive films 17, 17, the coil winding terminals 15, 15, the electrode layer 3 and the conductive metal plate 23 is formed except a part of the circumference of the end surface 13. Accordingly, it is possible to clean the coil winding 21 by utilizing the part of the circumference of the end surface 13 and the gap 28, so chemical effect on the coil winding, such as adherence of flux or the like, can be prevented. Further, the insulating layer 25 is filled also in the gap 28 of the feed-through hole 7, so the coil winding is perfectly sealed. In addition, the bonding between the magnetic sleeve and the magnetic bobbin is firmly performed by the insulating layer filled also in the gap. Because of the foregoing reasons, it is possible to obtain a chip-like inductance element which has excellent characteristics with constant quality without decrease in Q value.

Moreover, a cylindrical chip-like inductance element according to the present invention can be mounted on a printed circuit board by the multi-mounting method, hence it is possible to reduce the mounting cost.

What is claimed is:

1. A chip-like inductance element comprising:

a magnetic sleeve having a feed-through hole extending between two end surfaces thereof and electrode layers formed substantially on the entire end surfaces;

a drum-like magnetic bobbin which is fitted in the hole such that a gap is formed between the bobbin and the sleeve and which includes two end flanges having a diameter slightly smaller than the diameter of the hole and a central cylindrical region around which a coil winding is wound;

solder layers connecting terminals of the coil winding to the electrode layers except a part of the circumference of end surfaces of said end flanges of the drum-like magnetic bobbin; and insulating layers which cover the solder layers and said end surfaces of the drum-like magnetic bobbin, and fill said gap.

2. A chip-like inductance element according to claim 1 further including conductive metal pieces having solder layers thereon connecting together said solder layers and said electrode layers.

3. A chip-like inductance element according to claim 2 wherein said end surfaces of the magnetic sleeve are substantially circular.

4. A chip-like inductance element according to claim 2 wherein said end surfaces of the magnetic sleeve are substantially square.

* * * * *